US006663027B2

(12) United States Patent
Jameson et al.

(10) Patent No.: US 6,663,027 B2
(45) **Date of Patent: *Dec. 16, 2003**

(54) UNITIZED INJECTOR MODIFIED FOR ULTRASONICALLY STIMULATED OPERATION

(75) Inventors: Lee Kirby Jameson, Roswell, GA (US); Bernard Cohen, Berkeley Lake, GA (US); Lamar Heath Gipson, Ackworth, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 194 days.

This patent is subject to a terminal disclaimer.

(21) Appl. No.: 09/916,092

(22) Filed: Jul. 26, 2001

(65) Prior Publication Data

US 2002/0070298 A1 Jun. 13, 2002

Related U.S. Application Data

(60) Provisional application No. 60/254,683, filed on Dec. 11, 2000.

(51) Int. Cl.[7] ..... B05B 1/30; B05B 1/08; F02M 47/02; F02M 41/16

(52) U.S. Cl. ..... 239/585.1; 239/102.1; 239/102.2; 239/585.5; 239/88; 239/96

(58) Field of Search ..... 239/585.1, 585.3, 239/585.4, 585.5, 102.1, 102.2, 88, 96, 585.2, 91–95, 89, 90

(56) References Cited

U.S. PATENT DOCUMENTS

| | | | |
|---|---|---|---|
| 2,484,012 A | 10/1949 | Calhoun | |
| 2,484,014 A | 10/1949 | Peterson et al. | |

(List continued on next page.)

FOREIGN PATENT DOCUMENTS

| | | |
|---|---|---|
| DE | 2734818 | 2/1978 |
| DE | 3912524 A | 2/1989 |

(List continued on next page.)

OTHER PUBLICATIONS

DL 134052 (abstract); Assignee: Plast & Elastverarb VEB; Feb. 7, 1979.

(List continued on next page.)

*Primary Examiner*—Davis D. Hwu
(74) *Attorney, Agent, or Firm*—Dority & Manning, P.A.

(57) ABSTRACT

An ultrasonic fuel injector for injecting a pressurized liquid fuel into the combustion chamber of an internal combustion engine that uses an overhead cam for actuating the injector, includes an injector body and an injector needle. The injector needle is disposed within the body and includes a magnetostrictive portion disposed in the region of the body defined by a ceramic wall, which is transparent to magnetic fields changing at ultrasonic frequencies. A wire coil is wound around the outside surface of the ceramic wall and connected to a source of electric power that is controlled to oscillate at ultrasonic frequencies during predetermined intervals of operation of the injector. A sensor is configured to signal when the overhead cam is actuating the injector to inject fuel into the combustion chamber of the engine. The sensor is connected to a control that is connected to the power source and is configured to operate same only when the overhead cam is actuating the injector to inject fuel into the combustion chamber of the engine. When the power source activates the oscillating magnetic field in the coil and applies same to the magnetostrictive portion of the needle, ultrasonic energy is applied to the pressurized liquid. A method involves retrofitting conventional injectors with needles having magnetostrictive portions and wound coils configured and disposed so as to subject the magnetostrictive portions of the needles to ultrasonically oscillating magnetic fields.

20 Claims, 6 Drawing Sheets

U.S. PATENT DOCUMENTS 2,745,136 A 5/1956 Deboutteville
3,016,599 A 1/1962 Perry, Jr.
3,042,481 A 7/1962 Coggeshall
3,071,809 A 1/1963 Lerch
3,194,855 A 7/1965 Jones et al.
3,203,215 A 8/1965 Jones
3,233,012 A 2/1966 Bodine, Jr.
3,285,442 A 11/1966 Tigner
3,341,394 A 9/1967 Kinney
3,463,321 A 8/1969 Van Ingen
3,619,429 A 11/1971 Funabashi-shi
3,655,862 A 4/1972 Dorschner et al.
3,668,185 A 6/1972 Boutsicaris
3,679,132 A 7/1972 Vehe et al.
3,692,618 A 9/1972 Dorschner et al.
3,704,198 A 11/1972 Prentice
3,705,068 A 12/1972 Dobo et al.
3,715,104 A 2/1973 Cottell
3,729,138 A 4/1973 Tysk
3,749,318 A 7/1973 Cottell
3,755,527 A 8/1973 Keller et al.
3,802,817 A 4/1974 Matsuki et al.
3,819,116 A 6/1974 Goodinge et al.
3,849,241 A 11/1974 Butin et al.
3,853,651 A 12/1974 Porte
3,860,173 A 1/1975 Sata
3,884,417 A 5/1975 Sheffield et al.
3,949,127 A 4/1976 Ostermeier et al.
3,949,938 A 4/1976 Goodinge
3,977,604 A 8/1976 Yokoyama et al.
3,978,185 A 8/1976 Buntin et al.
4,013,223 A 3/1977 Martin
4,038,348 A 7/1977 Kompanek
4,048,963 A 9/1977 Cottell
4,064,605 A 12/1977 Akiyama et al.
4,067,496 A 1/1978 Martin
4,091,140 A 5/1978 Harmon
4,100,319 A 7/1978 Schwartz
4,100,324 A 7/1978 Anderson et al.
4,100,798 A 7/1978 Nilsson et al.
4,105,004 A 8/1978 Asai et al.
4,118,531 A 10/1978 Hauser
4,121,549 A 10/1978 Martin et al.
4,127,087 A 11/1978 Caves
4,127,624 A 11/1978 Keller et al.
4,134,931 A 1/1979 Hayes, Jr. et al.
4,159,703 A 7/1979 Mayer
4,198,461 A 4/1980 Keller et al.
4,218,221 A 8/1980 Cottell
4,239,720 A 12/1980 Gerlach et al.
4,288,398 A 9/1981 Lemelson
4,340,563 A 7/1982 Appel et al.
4,372,491 A 2/1983 Fishgal
4,389,999 A 6/1983 Jaqua
4,405,297 A 9/1983 Appel et al.
4,418,672 A 12/1983 Müller et al.
4,434,204 A 2/1984 Hartman et al.
4,466,571 A 8/1984 Mühlbauer
4,496,101 A 1/1985 Northman
4,500,280 A 2/1985 Astier et al.
4,521,364 A 6/1985 Norota et al.
4,526,733 A 7/1985 Lau
4,529,792 A 7/1985 Barrows
4,563,993 A 1/1986 Yamauchi et al.
4,576,136 A 3/1986 Yamauchi et al.
4,590,915 A 5/1986 Yamauchi et al.
4,627,811 A 12/1986 Greiser et al.
4,644,045 A 2/1987 Fowells
4,663,220 A 5/1987 Wisneski et al.
4,665,877 A 5/1987 Manaka et al.
4,715,353 A 12/1987 Koike et al.
4,716,879 A 1/1988 Takayama et al.
4,726,522 A 2/1988 Kokubo et al.
4,726,523 A 2/1988 Kokubo et al.
4,726,524 A 2/1988 Ishikawa et al.
4,726,525 A 2/1988 Yonekawa et al.
4,742,810 A 5/1988 Anders et al.
4,756,478 A 7/1988 Endo et al.
4,793,954 A 12/1988 Lee et al.
4,815,192 A 3/1989 Usui et al.
4,852,668 A 8/1989 Dickinson, III et al.
4,974,780 A 12/1990 Nakamura et al.
4,986,248 A 1/1991 Kobayashi et al.
4,995,367 A 2/1991 Yamauchi et al.
5,017,311 A 5/1991 Furusawa et al.
5,032,027 A 7/1991 Berliner, III
5,068,068 A 11/1991 Furusawa et al.
5,110,286 A 5/1992 Gaysert et al.
5,112,206 A 5/1992 Stewart
5,114,633 A 5/1992 Stewart
5,154,347 A 10/1992 Vijay
5,160,746 A 11/1992 Dodge, II et al.
5,169,067 A 12/1992 Matsusaka et al.
5,179,923 A 1/1993 Tsurutani et al.
5,226,364 A 7/1993 Fadner
5,269,981 A 12/1993 Jameson et al.
5,330,100 A 7/1994 Malinowski
5,382,400 A 1/1995 Pike et al.
5,531,157 A 7/1996 Probst
5,564,402 A 10/1996 Pöschl
5,801,106 A 9/1998 Jameson
5,803,106 A 9/1998 Cohen et al.
5,868,153 A 2/1999 Cohen et al.
5,892,315 A 4/1999 Gipson et al.
5,900,690 A 5/1999 Gipson et al.
6,010,592 A 1/2000 Jameson et al.
6,020,277 A 2/2000 Jameson
6,036,467 A 3/2000 Jameson
6,053,424 A 4/2000 Gipson et al.
6,315,215 B1 11/2001 Gipson
6,380,264 B1 4/2002 Jameson et al.
6,395,216 B1 5/2002 Jameson
6,450,417 B1 9/2002 Gipson et al.
6,543,700 B2 * 4/2003 Jameson et al. ..... 239/102.1

FOREIGN PATENT DOCUMENTS

DE 3734587 A1 5/1989
DK 865707 4/1961
EP 0165407 A2 12/1985
EP 0202100 A1 11/1986
EP 0202381 A1 11/1986
EP 0202844 B1 11/1986
EP 0235603 A2 9/1987
EP 0251524 B1 1/1988
EP 0303998 A1 2/1989
EP 0465660 A1 1/1992
EP 0644280 B1 3/1995
GB 582619 11/1946
GB 1263159 2/1972
GB 1382828 2/1975
GB 1415539 11/1975
GB 1432760 4/1976
GB 1555766 11/1979
GB 2077351 A 12/1981
GB 2082251 A 3/1982
GB 2274877 A 8/1994
JP 49(1974)-133613 12/1974
JP 03033444 2/1991
SU 468948 7/1975
SU 449504 10/1975
SU 1812332 A1 4/1990

| | | |
|---|---|---|
| WO | 93/01404 | 1/1993 |
| WO | 96/00318 | 1/1996 |
| WO | WO 97/23280 | 3/1997 |
| WO | WO 97/23726 | 3/1997 |
| WO | PCT/US01/50275 | 7/2002 |

OTHER PUBLICATIONS

DL 138523 (abstract); Assignee: VEB Lena–Werk W. Ulbrich; Nov. 7, 1979.

SU 706250 (abstract); Assignee: llyukhin Yu D; Dec. 31, 1979.

DE .3010985 (abstract); Assignee: Siemens AG; Oct. 1, 1981.

JP 56 144214 (abstract); Patentee: Idemitsu Kosan Co. Ltd.; Nov. 10, 1981.

JP 57 51441 (abstract); Assignee: Imperial Chem Inds PLC; Mar. 26, 1982.

JP 57 78967 A; (abstract); Assignee: Toshiba KK; May 17, 1982.

JP 57 099327 (abstract); Patentee: Toshia Corp.; Jun. 21, 1982.

JP 62 160110 A (abstract); Assignee; Fuji Photo Film Co. Ltd.; Jul. 16, 1987.

0 300 198 A1 (abstract) Assignee: Robert Bosch GMBH; Jan. 25, 1989.

0303889 B1 (abstract) Assignee: Weitkowitz Elek GMBH; Weitkowitz Eiektro; Feb. 22, 1989.

DE 2555839 A1 (abstract); Assignee: Deut Forsch Luft Raumfahrt EV; Nov. 2, 1989.

DE 3912524 A1 (abstract); Assignee: Deut Forsch Luft Raumfahrt EV; Nov. 2, 1989.

"Superfine Thermoplastic Fibers" by Van A. Wente, *Industrial and Engineering Chemistry*, vol. 48, No. 8, Aug. 1956, pp. 1342–1346.

"Manufacture of Superfine Organic Fibers" by V.A. Wente et al., *NRL Report* 4364, May 25, 1954, p. ii and pp. 1 through 15.

"Melt Blowing—A One–Step Web Process for New Nonwoven Products" by Robert r. Buntin, et al., *Tappi*, vol. 56. No. 4, Apr. 1973, pp. 74–77.

"Ultrasonics", *Encyclopedia of Chemical Technology*, 3rd ed., vol. 23, pp. 462–479.

"Degassing of Liquids", by O.A. Kapustina, *Physical Principles of Ultrasonic Technology*, vol. 1, Plenum Press, 1973, Table of Contents and pp. 376–509.

*Fundamental Principles of Polymerization*, by F.F. D'Alelio, John Wiley & Sons Inc., Dec. 1952, pp. 100–101.

* cited by examiner-

UNITIZED INJECTOR MODIFIED FOR ULTRASONICALLY STIMULATED OPERATION

PRIORITY CLAIM

The present application hereby claims priority based on provisional application Serial No. 60/254,683, which was filed on Dec. 11, 2000.

RELATED APPLICATIONS

This application is one of a group of commonly assigned patent applications which include application Ser. No. 08/576,543 entitled "An Apparatus and Method for Emulsifying A Pressurized Multi-Component Liquid", Docket No. 12535, in the name of L. K. Jameson et al.; and application Ser. No. 08/576,522 entitled "Ultrasonic Liquid Fuel Injection Apparatus and Method", Docket No. 12537, in the name of L. H. Gipson et al. The subject matter of each of these applications is hereby incorporated herein by this reference.

BACKGROUND OF THE INVENTION

The present invention relates to an apparatus and method for injecting fuel into a combustion chamber and in particular to a unitized fuel injector for engines that use overhead cams to actuate the injectors.

Diesel engines for locomotives use unitized fuel injectors that are actuated by overhead cams. One such typical conventional unitized injector is schematically represented in FIG. 1A and is generally designated by the numeral 10. This unitized injector 10 includes a valve body 11 that is disposed in an injector nut 29. The valve body 11 houses a needle valve that can be biased in the valve's closed position to prevent the injector from injecting fuel into one of the engine's combustion chambers, which is generally designated by the numeral 20.

As shown in FIG. 1B, which depicts an expanded cross-sectional view of a portion of the valve body 11 of FIG. 1A, the needle valve includes a conically shaped valve seat 12 that is defined in the hollowed interior of the valve body 11 and can be mated with and against a conically shaped tip 13 at one end of a needle 14. The hollowed interior of the valve body 11 further defines a fuel pathway 15 connecting to a fuel reservoir 16 and a discharge plenum 17, which is disposed downstream of the needle valve. Each of several exit channels 18 typically is connected to the discharge plenum 17 by an entrance orifice 19 and to the combustion chamber 20 by an exit orifice 21 at each opposite end of each exit channel 18. The needle valve controls whether fuel is permitted to flow from the storage reservoir 16 into the discharge plenum 17 and through the exit channels 18 into the combustion chamber 20.

As shown in FIG. 1B, the conically shaped tip 13 at one end of needle 14, which is housed in the hollowed interior of the valve body 11, is biased into sealing contact with valve seat 12 by a spring 22 (FIG. 1A). As shown in FIG. 1A, a cage 28 houses spring 22 so as to be disposed to apply its biasing force against the opposite end of the needle 14. A fuel pump 23 is disposed above the spring-biased end of the needle 14 and in axial alignment with the needle 14. Another spring 24 biases a cam follower 25 that is disposed above and in axial alignment with each of the fuel pump 23 and the spring-biased end of the needle 14. The cam follower 25 engages the plunger 26 that produces the pump's pumping action that forces pressurized fuel into the valve body 11 of the injector. An overhead cam 27 cyclically actuates the cam follower 25 to overcome the biasing force of spring 24 and press down on the plunger 26, which accordingly actuates the fuel pump 23. The fuel that is pumped into the valve body 11 via actuation of the pump 23 hydraulically lifts the conically shaped tip 13 of the needle 14 away from contact with the valve seat 12 and so opens the needle valve and forces a charge of fuel out of the exit orifices 21 of the injector 10 and into the combustion chamber 20 that is served by the injector.

However, the injector's exit orifices can become fouled and thereby adversely affect the amount of fuel that is able to enter the combustion chamber. Moreover, improving the fuel efficiency of these engines is desirable as is reducing unwanted emissions from the combustion process performed by such engines.

The goal of achieving more efficient combustion, which increases power and reduces pollution from the combustion process thereby improving the performance of injectors, has largely been sought to be accomplished by decreasing the size of the injector's exit orifices and/or increasing the pressure of the liquid fuel supplied to the exit orifice. Each of these solutions aims to increase the velocity of the fuel that exits the orifices of the injector.

However, these solutions introduce problems of their own such as: the need to use exotic metals; lubricity problems; the need to micro inch finish moving parts; the need to contour internal fuel passages; high cost; and direct injection. For example, the reliance on smaller orifices means that the orifices are more easily fouled. The reliance on higher pressures in the range of 1500 bar to 2000 bar means that exotic metals must be used that are strong enough to withstand these pressures without contorting in a manner that changes the characteristics of the injector if not destroying it altogether. Such exotic metals increase the cost of the injector. The higher pressures also create lubricity problems that cannot be solved by relying on additives in the fuel for lubrication of the injector's moving parts. Other means of lubricity such as applying a micro inch finish on the moving metal parts is required at great expense. Such higher pressures also create wear problems in the internal passages of the injector that must be counteracted by contouring the passages, which requires machining that is costly to perform. These wear problems also erode the exit orifices, and such erosion changes the character of the injector's plume over time and affects performance. Moreover, to achieve the higher pressures, the fuel pump must be localized with the injector for direct injection rather than disposed remotely from the injector.

Using ultrasonic energy to improve atomization of fuel injected into a combustion chamber is known, and advances in this field have been made as is evidenced by commonly owned U.S. Pat. Nos. 5,803,106; 5,868,153 and 6,053,424, which are hereby incorporated herein by this reference. These typically involve attaching an ultrasonic transducer on one end of an ultrasonic horn while the opposite end of the horn is immersed in the fuel in the vicinity of the injector's exit orifices and caused to vibrate at ultrasonic frequencies. However, unitized fuel injectors cannot be fitted with such ultrasonic transducers because of the disposition of the fuel pump, cam follower and overhead cam in axial alignment with the needle.

SUMMARY

Objects and advantages of the invention will be set forth in part in the following description, or may be obvious from the description, or may be learned through practice of the invention.

In a presently preferred embodiment of the present invention, the standard unitized injector actuated by overhead cams is retrofitted with a needle that has an elongated portion that is composed of magnetostrictive material. The portion of the injector's body surrounding the magnetostrictive portion of the retrofitted needle may be hollowed out and provided with an annular shaped insert that defines a wall surrounding the magnetostrictive portion of the retrofitted needle. This wall is composed of material that is transparent to magnetic fields oscillating at ultrasonic frequencies, and ceramic material can be used to compose the annular-shaped insert.

The exterior of the wall is surrounded by a coil that is capable of inducing a changing magnetic field in the region occupied by the magnetostrictive portion and thus causing the magnetostrictive portion to vibrate at ultrasonic frequencies. This vibration causes the tip of the needle, which is disposed in the liquid fuel near the entrance to the discharge plenum and the channels leading to the injector's exit orifices, to vibrate at ultrasonic frequencies and therefore subjects the fuel to these ultrasonic vibrations. The ultrasonic stimulation of the fuel as it leaves the exit orifices permits the injector to achieve the desired performance while operating at lower pressures and larger exit orifices than the conventional solutions that are aimed at increasing the velocity of the fuel exiting the injector.

In accordance with the present invention, a control is provided for actuation of the ultrasonically oscillating signal. The control is configured so that the actuation of the ultrasonically oscillating signal that is provided to the coil only occurs when the overhead cams are actuating the injector so as to allow fuel to flow through the injector and into the combustion chamber from the injector's exit orifices. Thus, the control operates so that the ultrasonic vibration of the fuel only occurs when fuel is flowing through the injector and into the combustion chamber from the injector's exit orifices. This control can include a sensor such as a pressure transducer that is disposed on the cam follower and includes a piezoelectric transducer.

Moreover, injectors can be made in accordance with the present invention as original equipment rather than as retrofits.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

As used herein, the term "liquid" refers to an amorphous (noncrystalline) form of matter intermediate between gases and solids, in which the molecules are much more highly concentrated than in gases, but much less concentrated than in solids. A liquid may have a single component or may be made of multiple components. The components may be other liquids, solids and/or gases. For example, a characteristic of liquids is their ability to flow as a result of an applied force. Liquids that flow immediately upon application of force and for which the rate of flow is directly proportional to the force applied are generally referred to as Newtonian liquids. Some liquids have abnormal flow response when force is applied and exhibit non-Newtonian flow properties.

A typical spray includes a wide variety of droplet sizes. Difficulties in specifying droplet size distributions in sprays have led to the use of various expressions of diameter. As used herein, the Sauter mean diameter (SMD) represents the ratio of the volume to the surface area of the spray (i.e., the diameter of a droplet whose surface to volume ratio is equal to that of the entire spray).

Figure 1A:
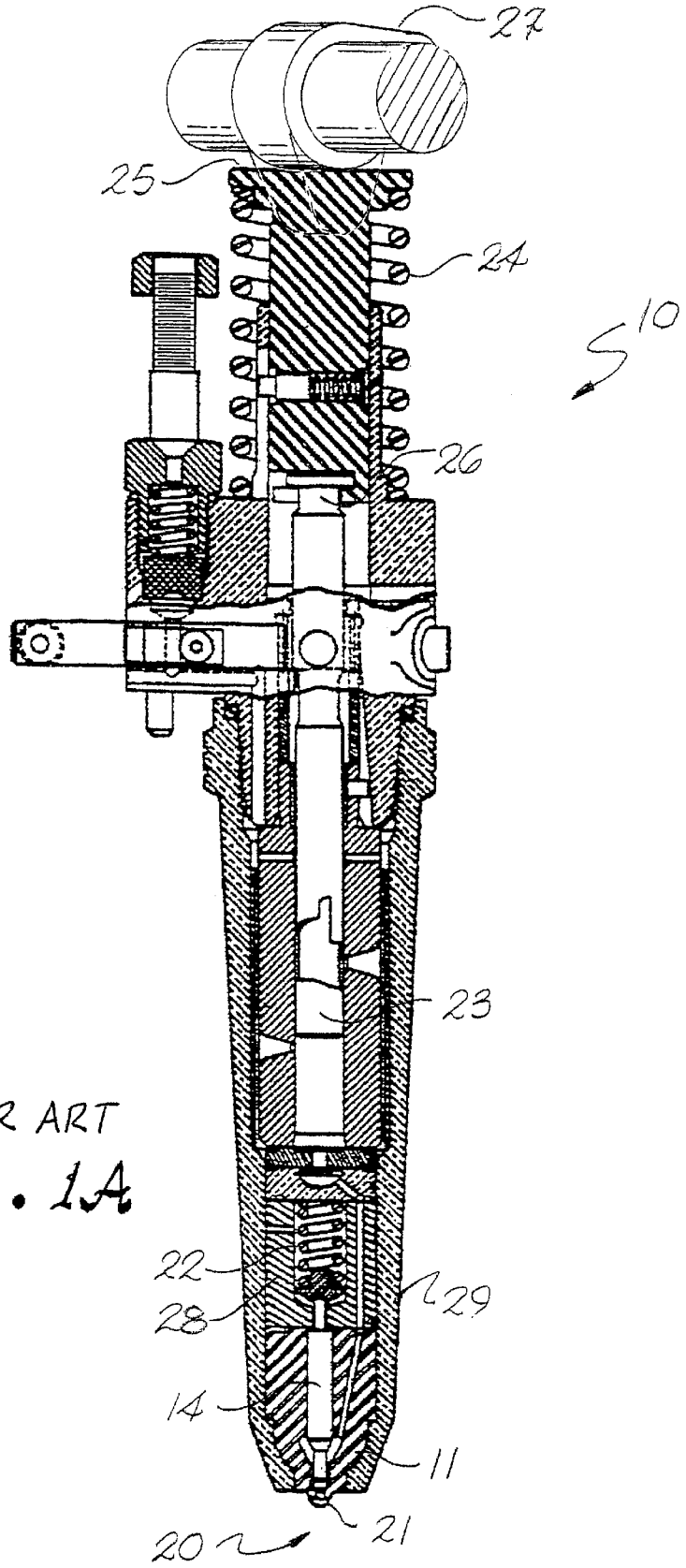
PRIOR ART Fig. 1A
FIG. 1A is a cross-sectional view of a conventional unitized fuel injector actuated by overhead cams.
Figure 1B:
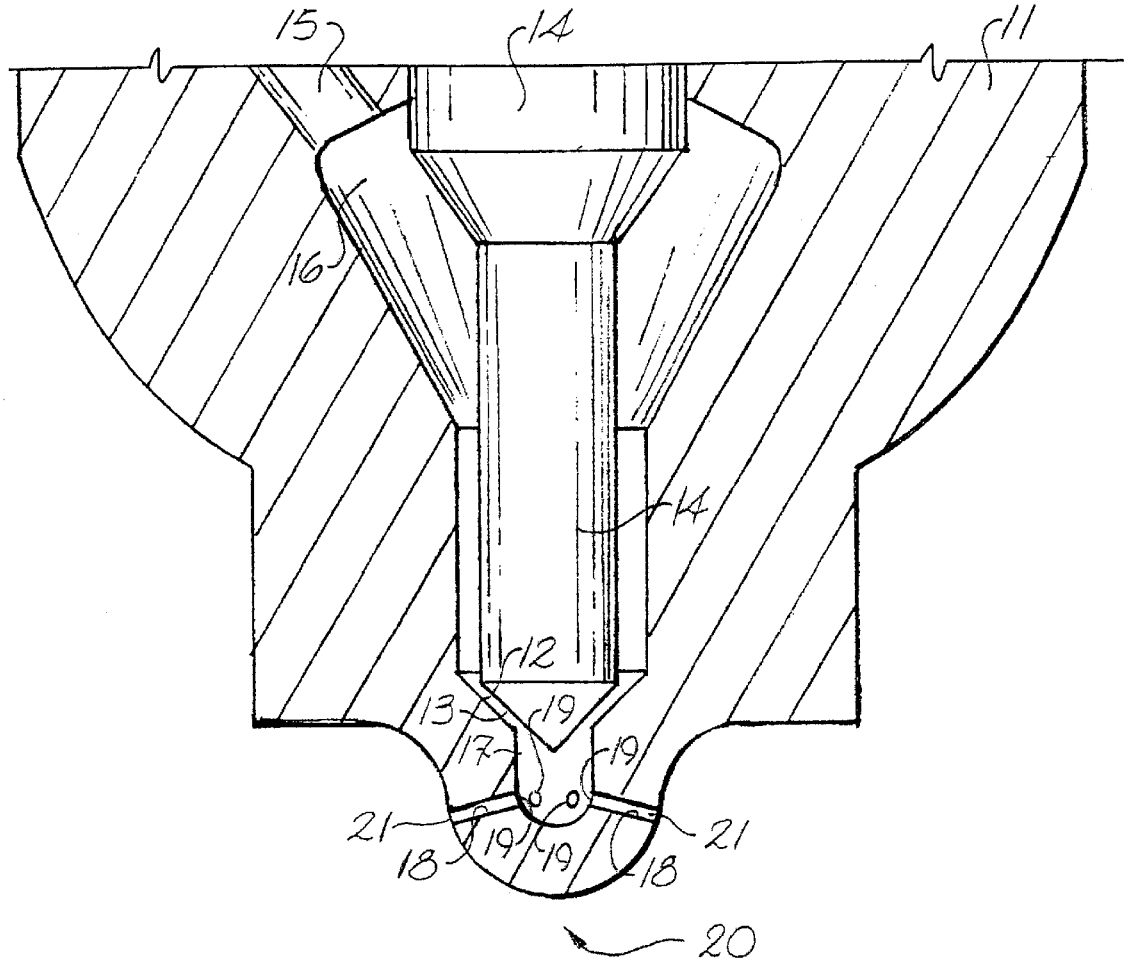
PRIOR ART Fig. 1B
FIG. 1B is an expanded cross-sectional view of a portion of the valve body of the conventional unitized fuel injector of FIG. 1A.
Figure 2:
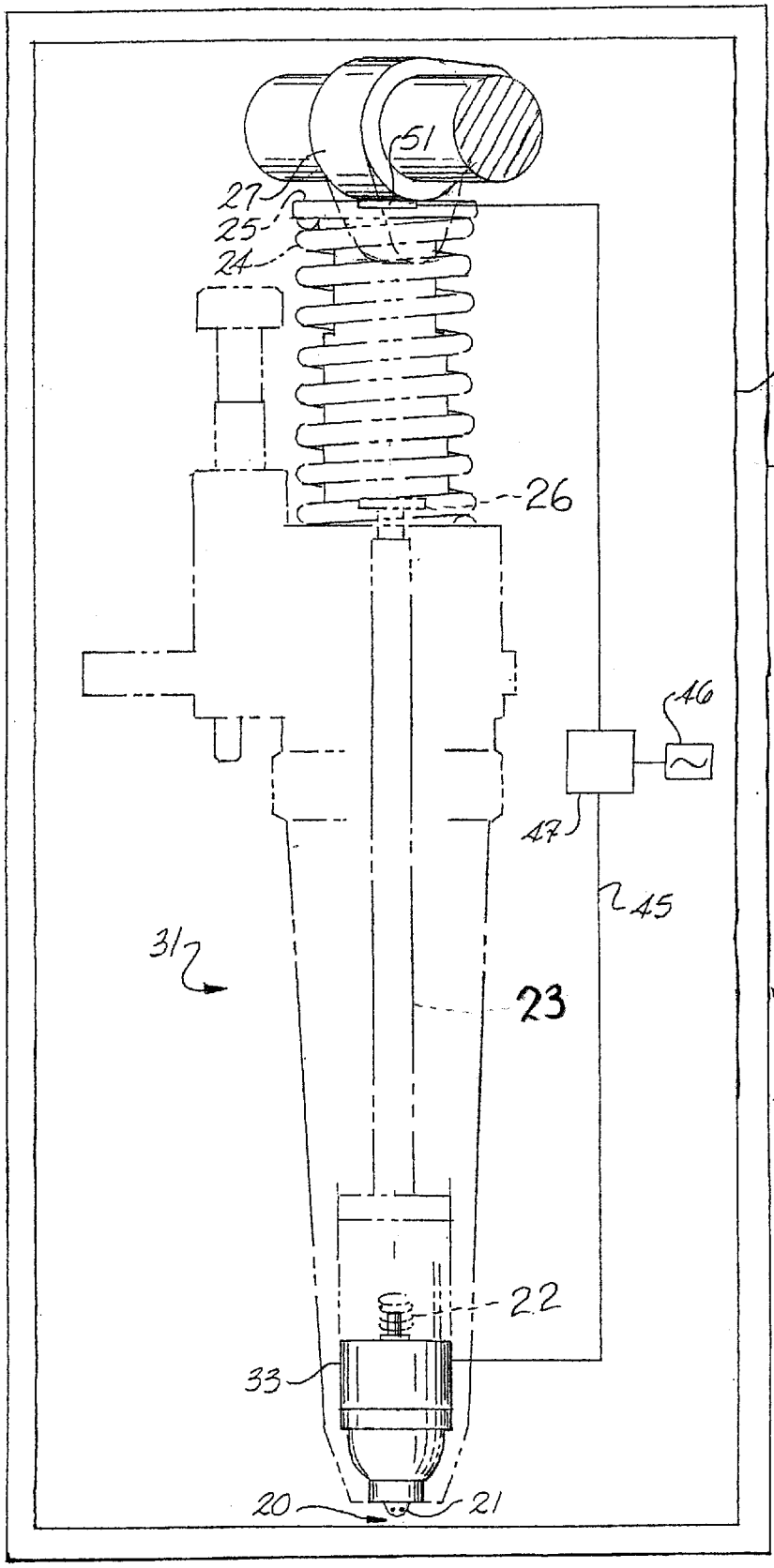
FIG. 2 is a diagrammatic representation of a partial perspective view with portions shown in phantom (dashed line) of one embodiment of the apparatus of the present invention.

In accordance with the present invention, as schematically shown in FIG. 2, not necessarily to scale, an internal combustion engine 30 with unitized fuel injectors 31 (only one being shown in FIG. 2) actuated by an overhead cam 27 forms the power plant of an exemplary apparatus, which is shown schematically and designated by the numeral 32. Such apparatus 32 could be almost any device that requires a power plant and would include but not be limited to an on site electric power generator, a land vehicle such as a railroad locomotive for example, an air vehicle such as an airplane, or a marine craft powered by diesel such as an ocean going vessel.

The ultrasonic fuel injector apparatus of the present invention is indicated generally in FIG. 2 by the designating numeral 31. Unitized injector 31 differs from the conventional unitized injector 10 described above primarily in the configuration of the valve body 33 and the needle 36 and in the addition of a sensor, a control and an ultrasonic power source, and these differences are described below. The remaining features and operation of the injector 31 of the present invention are the same as for the conventional unitized injector 10.

Figure 3:
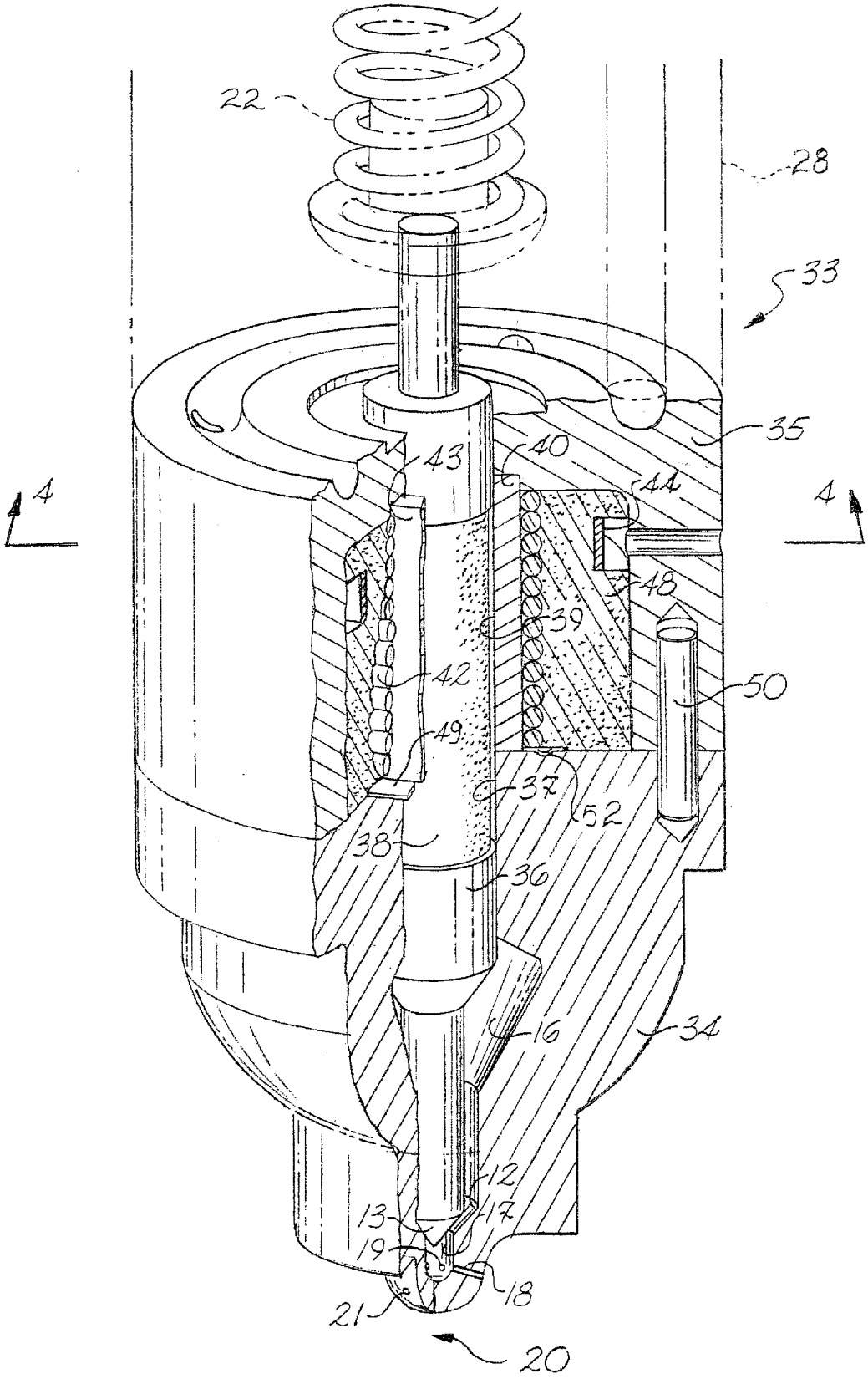
FIG. 3 is a partial perspective view of one embodiment of the valve body of the apparatus of the present invention with portions cut away and portions shown in cross-section and environmental structures shown in phantom (chain dashed line).
Figure 4:
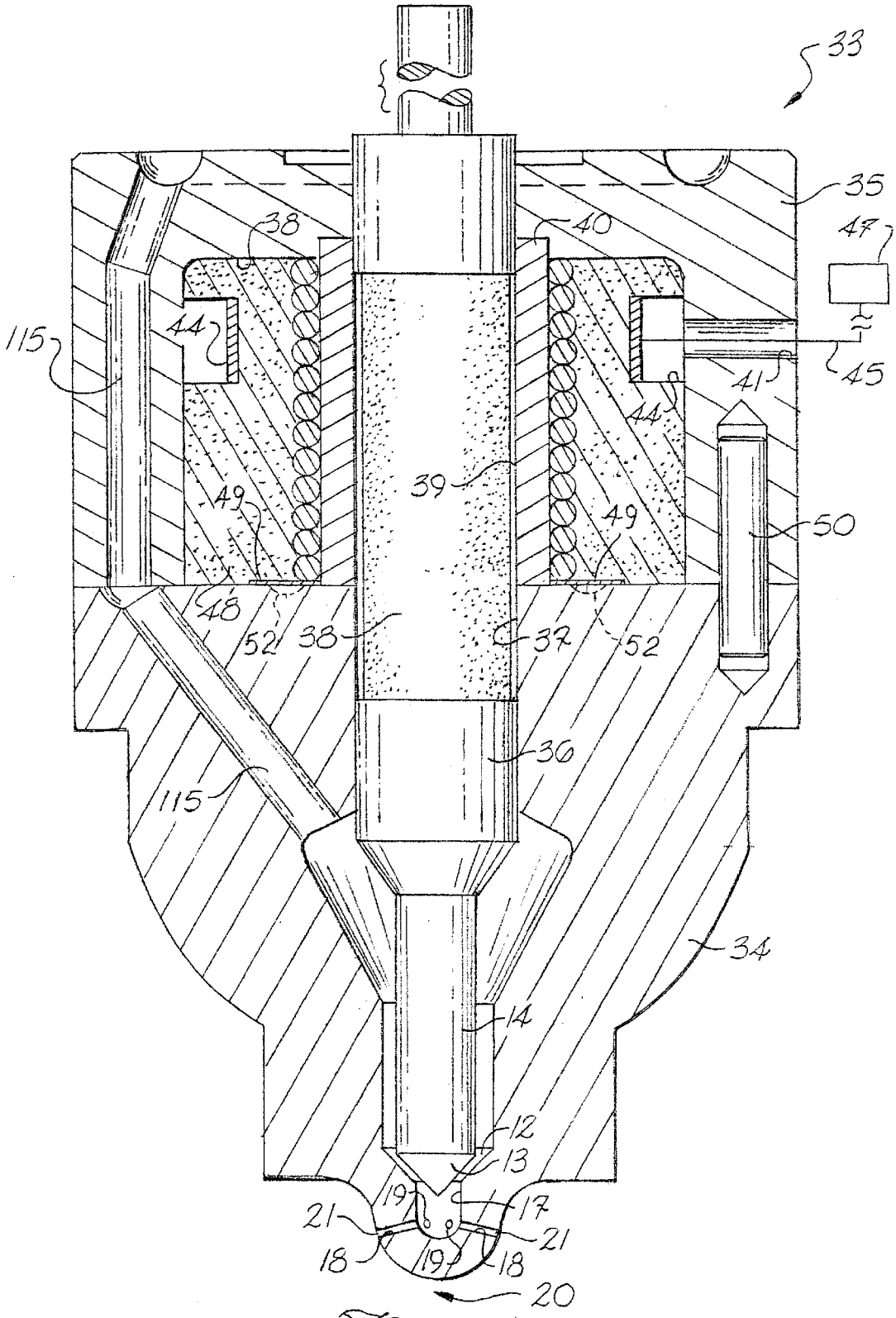
FIG. 4 is a cross-sectional view taken along the line designated 4—4 in FIG. 3.

An embodiment of the valve body 33 of injector 31 is shown in FIG. 3 in a perspective view that is partially cut away and in FIG. 4 in a cross-sectional view. The valve body 33 of the unitized ultrasonic fuel injector apparatus includes a nozzle 34, an housing 35 and an injector needle 36. External dimensions of the valve body 33 matched those of the conventional valve body 11 for the conventional injector 10 and likewise fit within the conventional injector nut 29. However, unlike the conventional valve body 11, valve body 33 of the present invention can include a two piece steel shell comprising a nozzle 34 and an housing 35.

The nozzle 34 is hollowed about most of the length of its central longitudinal axis and configured to receive therein the portion of the injector needle 36 having the conically shaped tip 13. The hollowed portion of the valve body defines the same fuel reservoir 16 as in the conventional valve body 11. Reservoir 16 is configured to receive and store an accumulation of pressurized fuel in addition to accommodating the passage therethrough of a portion of the injector needle 36. The hollowed nozzle portion 34 of the valve body 33 further defines the same discharge plenum 17 as in the conventional valve body 11. Plenum 17 communicates with the fuel reservoir 16 and is configured for receiving pressurized liquid fuel. The shape of the hollowed portion is generally cylindrically symmetrical to accommodate the external shape of the needle 36, but varies from the shape of the needle at different portions along the central axis of the valve body 33 to accommodate the fuel reservoir 16 and the discharge plenum 17. The differently shaped hollowed portions that are disposed along the central axis of the nozzle 34 generally communicate with one another and interact with the needle 36 in the same manner as these same features would in the conventional valve body 11 of the conventional injector 10.

The hollowed portion of the nozzle 34 of the valve body 33 also defines a valve seat 12 that is configured as in the conventional injector as a truncated conical section that connects at one end to the opening of the discharge plenum 17 and at the opposite end is configured in communication with the fuel reservoir 16. Thus, the discharge plenum 17 is connected to the fuel reservoir via the valve seat 12 in the same manner as in the conventional valve body 11.

In valve body 33, as in the conventional valve body 11, at least one and desirably more than one nozzle exit orifice 21 is defined through the lower extremity of the nozzle 34 of the injector. Each nozzle exit orifice 21 connects to the discharge plenum 17 via an exit channel 18 defined through the lower extremity of the injector's valve body and an entrance orifice 19 defined through the inner surface that defines the discharge plenum 17. Each channel 18 and its orifices 19, 21 may have a diameter of less than about 0.1 inches (2.54 mm). For example, the channel 18 and its orifices 19, 21 may have a diameter of from about 0.0001 to about 0.1 inch (0.00254 to 2.54 mm). As a further example, the channel 18 and its orifices 19, 21 may have a diameter of from about 0.001 to about 0.01 inch (0.0254 to 0.254 mm). The beneficial effects from the ultrasonic vibration of the fuel before the fuel leaves the exit orifice 21 of the injector 31 has been found to occur regardless of the size, shape, location and number of channels 18 and the orifices 19, 21 of same.

As shown in FIG. 4, the body of the injector's nozzle 34 also defines a fuel pathway 115 that is configured and disposed off-axis within the injector's valve body. The fuel pathway 115 is configured to supply pressurized liquid fuel to the fuel reservoir 16 and is connected to the fuel reservoir 16 and communicates with the discharge plenum 17.

In retrofitting a conventional valve body 11 to form valve body 33, modifications to the standard injector valve body 11 included relocating the three fuel feed passages 15. Nozzle material (SAE 51501) was removed from the housing 35 of valve body 33 corresponding to the minimal desired length of the axial bore of the valve body 33. This desired length is one third of the total length, which is the theoretical distance where fuel pressure reaches a minimum value, of the bore of the valve body 33. Relocation of the fuel feed passages required filling the original passages 15 of the conventional valve body 11 and machining new passages 115 at a greater radial distance from the centerline. Relocating the fuel feed passages 115 was done to allow for sufficient volume within the housing 35 of the valve body 33 for the electrical winding (described below).

As shown in FIG. 3, one end of the housing 35 is configured to be mated to the nozzle 34. The opposite end of the housing 35 is configured to be mated to the spring cage 28 (shown in dashed line in FIG. 3) that holds the spring 22 that biases the position of the needle 36 as in the conventional injector 10. Design considerations for the housing 35 included maintaining adequate surface area for sealing and sufficient internal volume for the electrical winding (described below). The objective of this design of housing 35 was to minimize stress concentrations and prevent high-pressure fuel leakage between mating parts. Sealing of high-pressure fuel is accomplished in this particular injector by mating surfaces between parts which are clamped together by the injector nut 29. The sealing, or contact, surfaces should be sized such that the contact pressure is significantly greater than the peak injection pressure that must be contained. The static pressure within the nozzle 34 is also the sealing pressure between the nozzle 34 and the mating housing 35. The sealing pressure included a sealing safety factor of 1.62 for an estimated peak injection pressure of 15,000 psi.

As illustrated in FIG. 3 for example, another critical location where high pressure fuel leakage is to be avoided is the annular volume between the external surface of the needle 36 and the internal surface 37 that defines the axial bore within the valve body 33. The internal bore 37 of the valve body 33 and the needle 36 disposed therein are selectively fitted to maintain minimal clearances and leakage. A value of 0.0002-inch is a typical maximum clearance between the external diameter of the needle 36 and the diameter of the bore 37 disposed immediately upstream of reservoir 16 in the nozzle 34.

The configuration and operation of the needle valve in the injector 31 of the present invention is the same as in the conventional injector 10 described above. As shown in FIG. 4. for example, the second end of the injector needle 36 defines a tip shaped with a conical surface 13 that is configured to mate with and seal against a portion of the conically shaped valve seat 12 defined in the hollowed portion of the injector's valve body 33. The opposite end of the injector needle 36 is connected so as to be biased into a position that disposes the conical surface 13 of the injector needle 36 into sealing contact with the conical surface of the valve seat 12 so as to prevent the fuel from flowing out of the fuel passageway 115, into the storage reservoir 16, into the discharge plenum 17, through the exit channels 18, out of the nozzle exit orifices 21 and into the combustion chamber 20. As shown schematically in FIG. 3, as in the conventional injector 11, a spring 22 provides one example of a means of biasing the conical surface 13 of the injector needle 36 into sealing contact with the conical surface 12 of the valve seat. Thus, when the injector needle 36 is disposed in its biased orientation, fuel cannot flow under the force of gravity alone from the fuel passageway 115 out of the nozzle exit orifices 21 and into the combustion chamber 20 into which the lower extremity of the fuel injector 31 is disposed.

As is conventional and schematically shown in FIG. 2 for example, the actuation of the cam 25 operates through the pump 23 to overcome the biasing force of spring 24 and force the conical end of the injector needle and the conically shaped valve seat apart. This opens the valve so as to permit the flow of fuel into the discharge plenum and out of the nozzle exit orifices 21 of the fuel injector 31 into the combustion chamber 20 of the engine 30 of the apparatus 32. This is accomplished as in the conventional unitized injectors 10 described above, i.e., by actuation of a pump 23 that forces pressurized fuel to hydraulically lift the needle 36 against the biasing force of the spring 22.

As used herein, the term "magnetostrictive" refers to the property of a sample of ferromagnetic material that results in changes in the dimensions of the sample depending on the direction and extent of the magnetization of the sample. Magnetostrictive material that is responsive to magnetic fields changing at ultrasonic frequencies means that a sample of such magnetostrictive material can change its dimensions at ultrasonic frequencies.

In accordance with the present invention, the injector needle defines at least a first portion 38 that is configured to be disposed in the central axial bore 37 defined within the valve body 33. As shown in FIGS. 3 and 4 for example, this first portion 38 of the injector needle 36 is indicated by the stippling and is formed of magnetostrictive material that is responsive to magnetic fields changing at ultrasonic frequencies. The length of the first portion 38 composed of magnetostrictive material can be about one third of the overall length of needle 36. However, the entire needle 36 can be formed of the magnetostrictive material if desired. A suitable magnetostrictive material is provided by an ETREMA TERFENOL-D7 magnetostrictive alloy, which can be bonded to steel to form the needle of the injector. The ETREMA TERFENOL-D7 magnetostrictive alloy is available from ETREMA Products, Inc. of Ames, Iowa 50010. Nickel and permalloy are two other suitable magnetostrictive materials.

Upon application of a magnetic field that is aligned along the longitudinal axis of the injector needle 36, the length of this first portion 38 of the injector needle 36 increases or decreases slightly in the axial direction. Upon removal of the aforementioned magnetic field, the length of this first portion 38 of the injector needle 36 is restored to its unmagnetized length. Moreover, the time during which the expansion and contraction occur is short enough so that the injector needle 36 can expand and contract at a rate that falls within ultrasonic frequencies, namely, 15 kilohertz to 500 kilohertz. The overall length of needle 36 in the needle's unmagnetized state is the same as the overall length of the conventional needle 14.

In further accordance with the present invention, the axial bore 37 of the injector's valve body 33 is defined at least in part by a wall 40 that is composed of material that is transparent to magnetic fields changing at ultrasonic frequencies. As embodied herein and shown in FIGS. 3 and 4 for example, this wall 40 can be composed of a non-metallic section defined by an insert composed of ceramic material such as partially stabilized zirconia, which is available from Coors Ceramic Company of Golden, Colo. The insert 40 defines the portion of the wall of the axial bore 37 that is transparent to magnetic fields changing at ultrasonic frequencies. The partially stabilized zirconia ceramic material of liner 40 has excellent material properties and satisfies the requirement for a non-conductive material between the winding (described below) and needle 36. Partially stabilized zirconia has relatively high compressive strength and fracture toughness compared to all other available technical ceramics.

The insert 40 functions as a liner that is formed as a cylindrical annular member that is disposed in a hollowed out portion of housing 35. The inner surface 39 of the insert 40 is disposed so as to coincide with the first portion 38 of the injector needle 36 that is disposed within the axial bore 37 of the valve body 33 of the injector 31. As shown in FIG. 4 for example, the internally hollowed portion 39 of the insert 40 of the valve body 33 defines a cylindrical cavity that is configured to receive therein at least a first portion 38 of the injector needle 36. The length of ceramic liner bore 39 comprised a majority of the axial bore 37 of the metallic portion of the valve body 33 and had a diameter that was sized 0.001 inch larger than the diameter of axial bore 37 in order to prevent binding of the needle 36 due to potential non-concentricity of the assembly.

In yet further accordance with the present invention, a means is provided for applying within the axial bore of the injector body, a magnetic field that can be changed at ultrasonic frequencies. The magnetic field can change from on to off or from a first magnitude to a second magnitude or the direction of the magnetic field can change. This means for applying a magnetic field changing at ultrasonic frequencies desirably is carried at least in part by the injector's valve body 33. As embodied herein and shown in FIG. 3 for example, the means for applying within the axial bore 37 a magnetic field changing at ultrasonic frequencies can include an electric power source 46 and a wire coil 42 that is wrapped around the outermost surface 43 of the ceramic insert or liner 40 and electrically connected to power source 46.

The electrical winding 42 was attached directly to the liner 40 and potted to prevent shorting of the coil's turns to the nozzle housing 35. As shown in FIGS. 3 and 4 for example, the wire coil 42 can be imbedded in potting material, which is generally represented by the stippled shading that is designated by the numeral 48. As shown in FIGS. 3 and 4 for example, electrical grounding of one end of the winding 42 was accomplished through contact with one side of a copper washer 49. The opposite side of washer 49, which could be formed of another conductive material besides copper, desirably features dimples 52 (dashed line in FIG. 4) that would compress against nozzle 34 when the valve body 33 is assembled in the metallic injector nut 29 and assure good electrical contact with nozzle 34.

Electrically connected to the other end of the winding 42 is a contact ring 44 that is embedded in the potting material 48 as shown in FIGS. 3 and 4 for example. Electrically connecting winding 42 to the ultrasonic power source 46 was accomplished through a spring loaded electrical probe 54 that was kept in electrical contact with contact ring 44. As shown in FIGS. 4 (schematically) and 5 (enlarged, cut-away perspective) for example, the back end of probe 54 is threaded through the injector nut 29, and an electrically insulating sleeve 55 surrounds the section of probe 54 that extends through a hole 41 in nozzle housing 35. To ensure that the hole 41 in the housing 35 lines up with the threaded hole in the injector nut 29 during assembly, a solid stainless-steel alignment pin 50 was fabricated and inserted into nozzle 34 and housing 35 as shown in FIGS. 3 and 4 for example.

Figure 5:
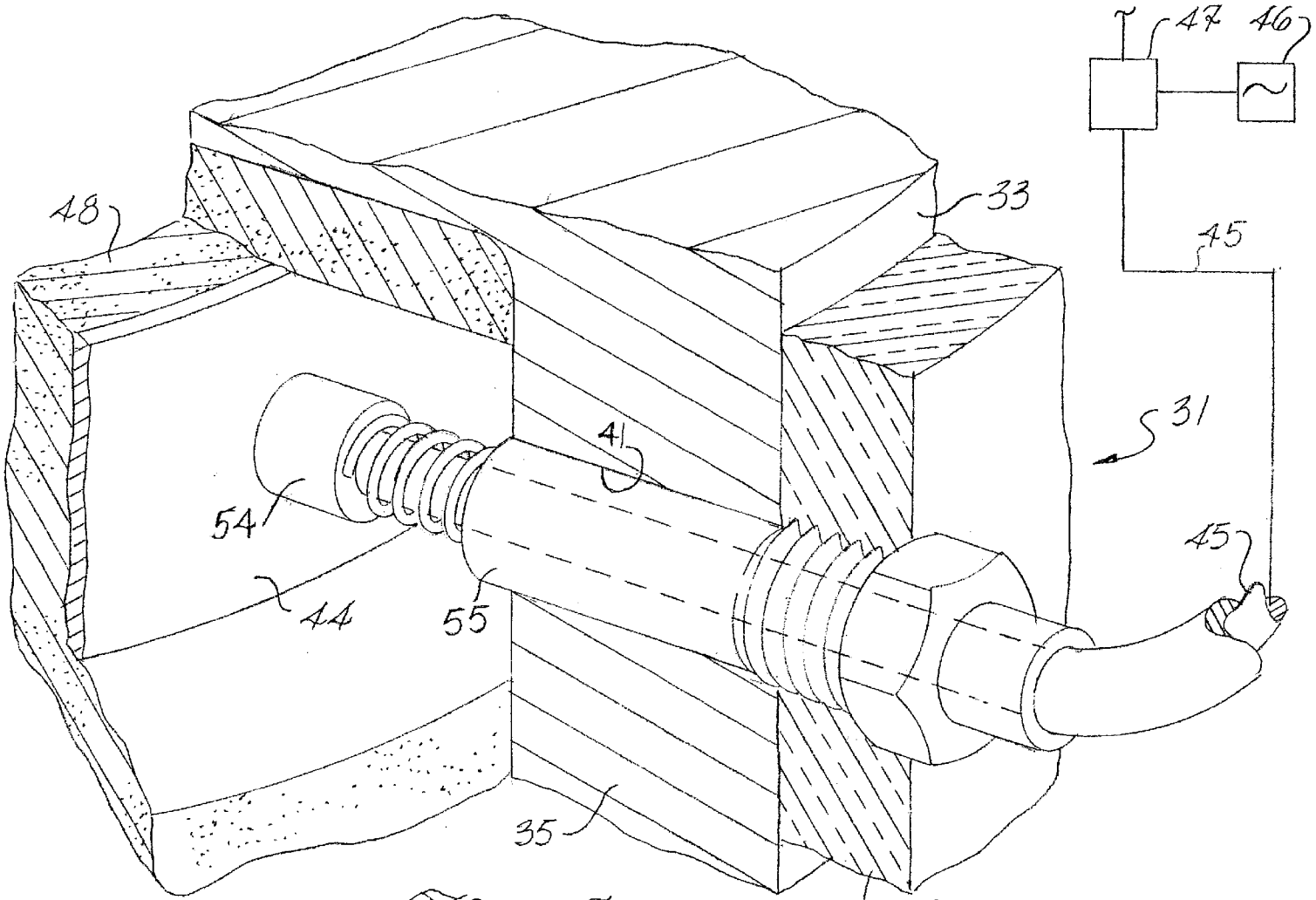
FIG. 5 is an expanded perspective view of one portion of an embodiment of the valve body of the apparatus of the present invention with portions cut away and portions shown in cross-section and environmental components shown schematically.

As shown schematically in FIGS. 2 and 5 for example, the probe 54 in turn can be connected to an electrical lead 45 that electrically connects to a source of electric power 46 that can be activated by a control 47 to oscillate at ultrasonic frequencies. From one perspective, the combination of the needle 36 composed of magnetostrictive material and the coil 42 function as a magnetostrictive transducer that converts the electrical energy provided the coil 42 into the mechanical energy of the expanding and contracting needle 36. A suitable example of a control 47 for such a magnetostrictive transducer is disclosed in commonly owned U.S. Pat. Nos. 5,900,690 and 5,892,315, which are hereby incorporated herein in their entirety by this reference. Note in particular FIG. 5 in U.S. Pat. Nos. 5,900,690 and 5,892,315 and the explanatory text of same.

In further accordance with the present invention, electrification of the coil 42 at ultrasonic frequencies is governed by the control 47 so that electrification of the coil 42 at ultrasonic frequencies occurs only when the injector needle 36 is positioned so that fuel flows from the storage reservoir 16 into the discharge plenum 17. As schematically shown in FIG. 2, control 47 can receive a signal from a pressure sensor 51 that is disposed on the cam follower 25 and detects when the cam 27 engages the follower 25. When the cam 27 depresses the follower 25, the pump 23 is actuated and pumps fuel into the valve body 33, thereby increasing the pressure in the fuel within the valve body 33 so as to hydraulically open the needle valve and cause fuel to be injected out of the exit orifices 21 of the injector 31. The pressure sensor 51 can include a pressure transducer such as a piezoelectric transducer that generates an electrical signal when subjected to pressure. Accordingly, pressure sensor 51 sends an electrical signal to the control 47, which can include an amplifier to amplify the electrical signal that is received from the sensor 51. Control 47 is configured to then provide this amplified electrical signal to activate the oscillating power source 46 that powers the coil 42 via lead 45 and induces the desired oscillating magnetic field in the magnetostrictive portion 38 of the needle 36. Control 47 also governs the magnitude and frequency of the ultrasonic vibrations through its control of power source 46. Other forms of control can be used to achieve the synchronization of the application of ultrasonic vibrations and the injection of fuel by the injector, as desired.

During the injection of fuel, the conically-shaped end 13 of the injector needle 36 is disposed so as to protrude into the discharge plenum 17. The expansion and contraction of the length of the injector needle 36 caused by the elongation and retraction of the magnetostrictive portion 38 of the injector needle 36 is believed to cause the conically-shaped end 13 of the injector needle 36 to move respectively a small distance into and out of the discharge plenum 17 as would a sort of plunger. This in and out reciprocating motion is believed to cause a commensurate mechanical perturbation of the liquid fuel within the discharge plenum 17 at the same ultrasonic frequency as the changes in the magnetic field in the magnetostrictive portion 38 of the injector needle 36. This ultrasonic perturbation of the fuel that is leaving the injector 311 through the nozzle exit orifices 21 results in improved atomization of the fuel that is injected into the combustion chamber 20. Such improved atomization results in more efficient combustion, which increases power and reduces pollution from the combustion process. The ultrasonic vibration of the fuel before the fuel exits the injector's orifices produces a plume that is an uniform, cone-shaped spray of liquid fuel into the combustion chamber 20 that is served by the injector 31.

The actual distance between the tip 13 of the needle 36 and the entrance orifice 19 or the exit orifice 21 when the needle valve is opened in the absence of the oscillating magnetic field was not changed from what it was in the conventional valve body 11. In general, the minimum distance between the tip 13 of the needle 36 and the entrance orifice 19 of the channels 18 leading to the exit orifices 21 of the injector 31 in a given situation may be determined readily by one having ordinary skill in the art without undue experimentation. In practice, such distance will be in the range of from about 0.002 inches (about 0.05 mm) to about 1.3 inches (about 33 mm), although greater distances can be employed. Such distance determines the extent to which ultrasonic energy is applied to the pressurized liquid other than that which is about to enter the entrance orifice 19. In other words, the greater the distance, the greater the amount of pressurized liquid which is subjected to ultrasonic energy. Consequently, shorter distances generally are desired in order to minimize degradation of the pressurized liquid and other adverse effects which may result from exposure of the liquid to the ultrasonic energy.

Immediately before the liquid fuel enters the entrance orifice 19, the vibrating tip 13 that contacts the liquid fuel applies ultrasonic energy to the fuel. The vibrations appear to change the apparent viscosity and flow characteristics of the high viscosity liquid fuels. The vibrations also appear to improve the flow rate and/or improve atomization of the fuel stream as it enters the combustion chamber 20. Application of ultrasonic energy appears to improve (e.g., decrease) the size of liquid fuel droplets and narrow the droplet size distribution of the liquid fuel plume. Moreover, application of ultrasonic energy appears to increase the velocity of liquid fuel droplets exiting the injector's orifice 21 into the combustion chamber 20. The vibrations also cause breakdown and flushing out of clogging contaminants at the injector's entrance orifices 19, channels 18 and exit orifices 21. The vibrations can also cause emulsification of the liquid fuel with other components (e.g., liquid components) or additives that may be present in the fuel stream.

The injector 31 of the present invention may be used to emulsify multi-component liquid fuels as well as liquid fuel additives and contaminants at the point where the liquid fuels are introduced into the internal combustion engine 30. For example, water entrained in certain fuels may be emulsified by the ultrasonic vibrations so that fuel/water mixture may be used in the combustion chamber 20. Mixed fuels and/or fuel blends including components such as, for example, methanol, water, ethanol, diesel, liquid propane gas, bio-diesel or the like can also be emulsified. The present invention can have advantages in multi-fueled engines in that it may be used so as to render compatible the flow rate characteristics (e.g., apparent viscosities) of the different fuels that may be used in the multi-fueled engine. Alternatively and/or additionally, it may be desirable to add water to one or more liquid fuels and emulsify the components immediately before combustion as a way of controlling combustion and/or reducing exhaust emissions. It may also be desirable to add a gas (e.g., air, $N_2O$, etc.) to one or more liquid fuels and ultrasonically blend or emulsify the components immediately before combustion as a way of controlling combustion and/or reducing exhaust emissions.

One advantage of the injector 31 of the present invention is that it is self-cleaning. Because of the ultrasonic vibration of the fuel before the fuel exits the injector's orifices 21, the vibrations dislodge any particulates that might otherwise clog the channel 18 and its entrance and exit orifices 19, 21, respectively. That is, the combination of supplied pressure and forces generated by ultrasonically exciting the needle 36 amidst the pressurized fuel directly before the fuel leaves the nozzle 34 can remove obstructions that might otherwise block the exit orifice 21. According to the invention, the channel 18 and its entrance orifice 19 and exit orifice 21 are thus adapted to be self-cleaning when the injector's needle 36 is excited with ultrasonic energy (without applying ultrasonic energy directly to the channel 18 and its orifices 19, 21) while the exit orifice 21 receives pressurized liquid from the discharge chamber 17 and passes the liquid out of the injector 31.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. An ultrasonic, unitized fuel injector apparatus for injection of pressurized liquid fuel into an internal combustion engine that actuates the injector by at least one overhead cam contacting a cam follower, the apparatus comprising:

a valve body defining:

a cavity configured to receive therein at least a first portion of an injector needle, said cavity being defined at least in part by a wall that is transparent to magnetic fields changing at ultrasonic frequencies, a discharge plenum communicating with said cavity and configured for receiving pressurized liquid fuel and at least a second portion of said injector needle, a fuel pathway communicating with said discharge plenum and configured to supply the pressurized liquid fuel to said discharge plenum, and an exit orifice communicating with said discharge plenum and configured to receive the pressurized liquid fuel from said discharge plenum and pass the liquid fuel out of said valve body;

a means for applying within said cavity a magnetic field changing at ultrasonic frequencies, said means being carried at least in part by said valve body;

an injector needle having a first portion disposed in said cavity and a second portion disposed in said discharge plenum, said first portion of said injector needle being formed of magnetostrictive material responsive to magnetic fields changing at ultrasonic frequencies;

a sensor configured to signal when the injector is injecting pressurized liquid fuel into the internal combustion engine; and a control connected to said sensor and to said means for applying within said cavity a magnetic field changing at ultrasonic frequencies, said control being configured to activate said means for applying within said cavity a magnetic field changing at ultrasonic frequencies when said sensor signals that the injector is injecting fuel into the combustion chamber of the engine.

2. The apparatus of claim 1, wherein said wall includes ceramic material.

3. The apparatus of claim 2, wherein said means for applying within said cavity a magnetic field changing at ultrasonic frequencies includes an electrically conducting coil disposed around said wall.

4. The apparatus of claim 2, wherein said valve body is composed of a metal section and a non-metal section, and said non-metal section includes said wall of said cavity.

5. The apparatus of claim 4, wherein said wall of said cavity is defined by an insert composed of ceramic material.

6. The apparatus of claim 5, wherein said insert is configured as a cylindrical annular member.

7. The apparatus of claim 6, wherein said means for applying within said cavity a magnetic field changing at ultrasonic frequencies includes an electrically conducting coil disposed around said ceramic insert.

8. The apparatus of claim 7, wherein said non-metal section of said valve body includes potting material embedding said electrically conducting coil therein.

9. The apparatus of claim 5, wherein said means for applying within said cavity a magnetic field changing at ultrasonic frequencies includes a power source and an electrically conducting coil disposed around said ceramic insert.

10. The apparatus of claim 4, wherein said means for applying within said cavity a magnetic field changing at ultrasonic frequencies includes an electrically conducting coil disposed around said wall of said cavity, and said non-metal section of said valve body includes potting material embedding said electrically conducting coil therein.

11. The apparatus of claim 1, wherein said means for applying within said cavity a magnetic field changing at ultrasonic frequencies is disposed at least in part within said valve body.

12. The apparatus of claim 1, wherein said sensor includes a piezoelectric transducer that is disposed to detect a predetermined magnitude of pressure from contact by at least one of the cams with a cam follower.

13. The apparatus of claim 1, wherein said means for applying within said cavity a magnetic field changing at ultrasonic frequencies includes an electrically conducting coil disposed around said cavity.

14. The apparatus of claim 1, further comprising a plurality of exit orifices, each said exit orifice being configured and disposed to communicate with said discharge plenum and to receive the pressurized liquid fuel from said discharge plenum and pass the liquid fuel out of said valve body.

15. The apparatus of claim 1, wherein the ultrasonic frequencies range from about 15 kHz to about 500 kHz.

16. The apparatus of claim 1, wherein the ultrasonic frequencies range from about 15 kHz to about 60 kHz.

17. An internal combustion engine, wherein said engine includes the apparatus of claim 1.

18. A vehicle, comprising: the engine of claim 17.

19. An electric generator, comprising: the engine of claim 17.

20. An ultrasonic, unitized fuel injector apparatus for injection of pressurized liquid fuel into an internal combustion engine that actuates the injector by overhead cams, the apparatus comprising:

a valve body defining:

a cavity configured to receive therein at least a first portion of an injector needle, a discharge plenum communicating with said cavity and configured for receiving pressurized liquid fuel and at least a second portion of said injector needle, a fuel pathway communicating with said discharge plenum and configured to supply the pressurized liquid fuel to said discharge plenum, and an exit orifice communicating with said discharge plenum and configured to receive the pressurized liquid fuel from said discharge plenum and pass the liquid fuel out of said valve body;

a means for applying within said cavity a magnetic field changing at ultrasonic frequencies, said means being carried at least in part by said valve body;

an injector needle having a first portion disposed in said cavity and a second portion disposed in said discharge plenum, said first portion of said injector needle being formed of magnetostrictive material responsive to magnetic fields changing at ultrasonic frequencies;

a sensor configured to signal when the injector is injecting pressurized liquid fuel into the internal combustion engine; and a control connected to said sensor and to said means for applying within said cavity a magnetic field changing at ultrasonic frequencies, said control being configured to activate said means for applying within said cavity a magnetic field changing at ultrasonic frequencies when said sensor signals that the injector is injecting fuel into the combustion chamber of the engine.

* * * * *